US005803468A

United States Patent [19]

Petrucci et al.

[11] Patent Number: 5,803,468

[45] Date of Patent: Sep. 8, 1998

[54] BRAKE AND REMOTE CONTROL SYSTEM FOR WHEELED SKATE

[76] Inventors: Gary M. Petrucci, 2975 County Rd. 24, Medina, Minn.; Johannes J. W. G. M. Huijbers, 14327 Valley View Rd. Apt. E, Eden Prairie, Minn. 55344

[21] Appl. No.: 648,207

[22] Filed: May 14, 1996

[51] Int. Cl.[6] ..... A63C 17/14

[52] U.S. Cl. ..... 280/11.1; 280/11.22; 188/18 A; 188/72.4

[58] Field of Search ..... 188/18 A, 72.4, 188/344; 303/3, 20; 280/11.2, 11.22

[56] References Cited

U.S. PATENT DOCUMENTS

| | | | |
|---|---|---|---|
| 1,801,205 | 4/1931 | Mirick . | |
| 2,535,763 | 12/1950 | Tucker | 188/72.4 X |
| 2,616,525 | 11/1952 | Du Bois | 188/72.4 X |
| 3,858,692 | 1/1975 | Luchier et al. | 188/18 A X |
| 4,108,451 | 8/1978 | Scheck, Sr. . | |
| 4,300,781 | 11/1981 | Riggs . | |
| 4,805,936 | 2/1989 | Krantz . | |
| 4,943,075 | 7/1990 | Gates . | |
| 5,106,110 | 4/1992 | Williamson . | |
| 5,171,032 | 12/1992 | Dettmer . | |
| 5,211,409 | 5/1993 | Mitchell et al. . | |
| 5,226,673 | 7/1993 | Cech . | |
| 5,236,058 | 8/1993 | Yamet et al. . | |
| 5,239,941 | 8/1993 | Chibi . | |
| 5,251,934 | 10/1993 | Gates . | |
| 5,253,882 | 10/1993 | Mitchell . | |
| 5,280,930 | 1/1994 | Smathers et al. . | |
| 5,286,043 | 2/1994 | Tkaczyk . | |
| 5,312,120 | 5/1994 | Wiegner . | |
| 5,316,325 | 5/1994 | Mitchell et al. | 280/11.2 |
| 5,320,367 | 6/1994 | Landis | 280/11.2 |
| 5,330,207 | 7/1994 | Mitchell | 280/11.2 |
| 5,340,131 | 8/1994 | Smather et al. | 280/11.22 |
| 5,351,974 | 10/1994 | Cech | 280/11.2 |
| 5,374,071 | 12/1994 | Johnson | 280/11.2 |
| 5,398,950 | 3/1995 | Tkaczyk | 280/11.23 |
| 5,411,276 | 5/1995 | Moldenhauer | 280/11.2 |
| 5,415,419 | 5/1995 | Bourque | 280/11.2 |
| 5,439,238 | 8/1995 | Neal | 280/11.2 |
| 5,464,235 | 11/1995 | Goldman et al. | 280/11.2 |
| 5,564,718 | 10/1996 | Mitchell et al. | 280/11.22 X |

FOREIGN PATENT DOCUMENTS

| | | | |
|---|---|---|---|
| 219682 | 2/1942 | Switzerland | 280/11.2 |

*Primary Examiner*—Peter M. Poon
*Attorney, Agent, or Firm*—Dorsey & Whitney LLP

[57] ABSTRACT

An in-line skate having a fluid pressure brake which is fully remotely controlled via a radio frequency transmitter. The skate further includes a wheel support frame, a fluid pressure chamber defined by the wheel support frame and a source of fluid pressure carried by the frame to selectively provide a braking force to the skate wheel.

18 Claims, 5 Drawing Sheets

BRAKE AND REMOTE CONTROL SYSTEM FOR WHEELED SKATE

BACKGROUND OF THE INVENTION

1. Field of the Invention

The present invention relates generally to an improved fluid pressure brake, and more particularly to a fluid pressure actuated brake for a wheeled skate and a remote control brake system for a wheeled skate.

2. Description of the Prior Art

During the past decade, the popularity of roller or in-line skating has literally exploded. This is due in part to the great similarity between in-line skating and ice skating. Although the skating strides, turns, etc of in-line skating are very similar to those of ice skating, the stopping or braking of in-line or other wheeled skates is completely different. Accordingly, significant development has occurred relative to devices and systems for stopping or braking on in-line skates.

A variety of braking methods and apparatus have been developed for in-line skates. Two general types currently exist: hand operated brakes and foot operated brakes. Some hand operated brakes such as those exemplified by U.S. Pat. No. 5,349,238, U.S. Pat. No. 5,411,276 and U.S. Pat. No. 5,330,207 utilize a cable between a hand held brake actuator and a brake device mounted to one or both of the skates. Other hand operated brakes such as those exemplified by U.S. Pat. No. 5,280,930 and U.S. Pat. No. 5,340,131 utilize a hydraulic conduit or line extending from a hand actuator to a brake on the skate. Although hand operated brakes function, satisfactorily, they are not widely used. A principal reason for their limited use is the fact that the cable or other linkage between the hand held actuator and the skate mounted brake places restrictions on hand and arm movements which are important for balance.

Foot mounted brakes typically rely on one or more of several techniques for applying the brake force. One system involves use of various types of skid pads located at the toe or heel of the skate and are simply dragged on the skating surface. A second technique involves utilizing an auxiliary wheel or roller which makes contact with a brake pad or a braking surface. A third technique involves forcing one or more of the load bearing wheels against a braking surface. A further technique involves the use of various types of spring bias brakes.

Foot brakes also function satisfactorily and are currently the brakes of choice for in-line skates. However, foot brakes necessarily require manipulation and/or special orientation of at least one of the skates during the braking process. This often increases the stopping distance. Although the current hand held brake designs eliminates manipulation and/or special orientation of the skate, it is hampered by the cable or other linkage between the hand held actuator and the skate.

Accordingly, there is a need in the art for an improved brake system, and in particular, a remote control hand operated brake system for in-line or other wheeled skates which eliminates the need for cables or other linkages between the actuator and the skate. There is also a need in the art for an improved fluid pressure actuated brake system for in-line or other wheeled skates whether combined with a remote hand held actuator or not.

SUMMARY OF THE INVENTION

In contrast to the prior art, the present invention relates to an improved fluid pressure actuated brake for a rotatable member, an improved fluid pressure actuated brake for an in-line or other wheeled skate and a remotely controlled brake system for an in-line or other wheeled skate. The fluid pressure actuated brake in accordance with the present invention includes a fluid cylinder means for generating fluid pressure sufficient to actuate the brake mechanism. The fluid pressure brake mechanism is associated with the rotatable member or at least one wheel of the in-line skate and preferably includes a fluid pressure actuated brake piston on each side of the wheel in order to balance the actuation forces. The wheel includes a pair of generally annular braking surfaces opposed to one another for selective braking engagement with second braking surfaces associated with corresponding opposed brake pistons. One of braking surfaces is preferably provided with a friction brake pad.

In the preferred embodiment, the braking surfaces and the brake pistons have an annular configuration which completely encircles the wheel supporting shaft. This maximizes the available piston braking surface and thus reduces the maximum brake pressure required. Further, the actuation force for the brake pistons is located along the axis of the shaft supporting the wheel. This allows for the shaft rather than the frame to resist the actuation force of the brake.

The present invention also includes a mechanism for selectively generating the fluid pressure needed to operate the brake and a fully remote control brake system. The remote control system controls actuation of the fluid pressure source, and thus the brake, and completely eliminates any cables or other mechanical linkages between the hand held actuator and the skate. Accordingly, with the remote control system of the present invention, movement of the arms is not restricted as in other hand actuated in-line brake systems.

The preferred remote control system of the present invention includes a remote hand held radio signal transmitter, a radio signal receiver and the fluid pressure source means carried by the frame of the skate with which the transmitter is associated. During operation, the radio transmitter sends out a coded signal comprised of two parts: a code signal part allowing the receiver to validate the origin of the signal so that the brake can be actuated only by the transmitter of the skater, and a brake control signal part controlling the actuation of the fluid pressure source to an extent proportional to the desired braking force. In the preferred embodiment, the transmitter is provided with a spring loaded actuation button which the user depresses for transmission of the coded signal. The spring has a variable force resistance that provides the user with feedback of the braking force.

Accordingly, it is an object of the present invention to provide an improved fluid pressure actuated brake for a rotatable member which maximizes the braking surfaces, and thus reduces the necessary braking pressures and which causes the actuation force to be resisted by the shaft.

Another object of the present invention is to provide an improved fluid pressure actuated brake for a rotatable member supported on a rotation shaft in which the braking surfaces and the brake pistons have a generally annular configuration and completely encircle the rotation shaft.

A further object of the present invention is to provide an improved fluid pressure actuated brake for a wheeled skate such as an in-line skate.

A further object of the present invention is to provide a remote control actuation system for an in-line or other wheeled skate.

A still further object of the present invention is to provide a remote control system and a fluid pressure actuated brake for an in-line or other wheeled skate.

These and other objects of the present invention will become apparent with reference to the drawings, the description of the preferred embodiment and the appended claims.

DESCRIPTION OF THE PREFERRED EMBODIMENT

The present invention relates to a fluid pressure brake for braking a rotating member such as a wheel supported on a rotation shaft and a remote control system for remotely controlling actuation of an in-line or other wheeled skate brake. Although it is intended that the brake and the remote control system for the brake may be used in a variety of applications including various personal wheeled vehicles or the like, it has particular application to wheeled skates and specifically to wheeled skates which are commonly referred to as in-line skates. Accordingly, the preferred embodiment of the present invention will be described with respect to a fluid pressure brake and a remote control brake system for an in-line skate.

Figure 1:
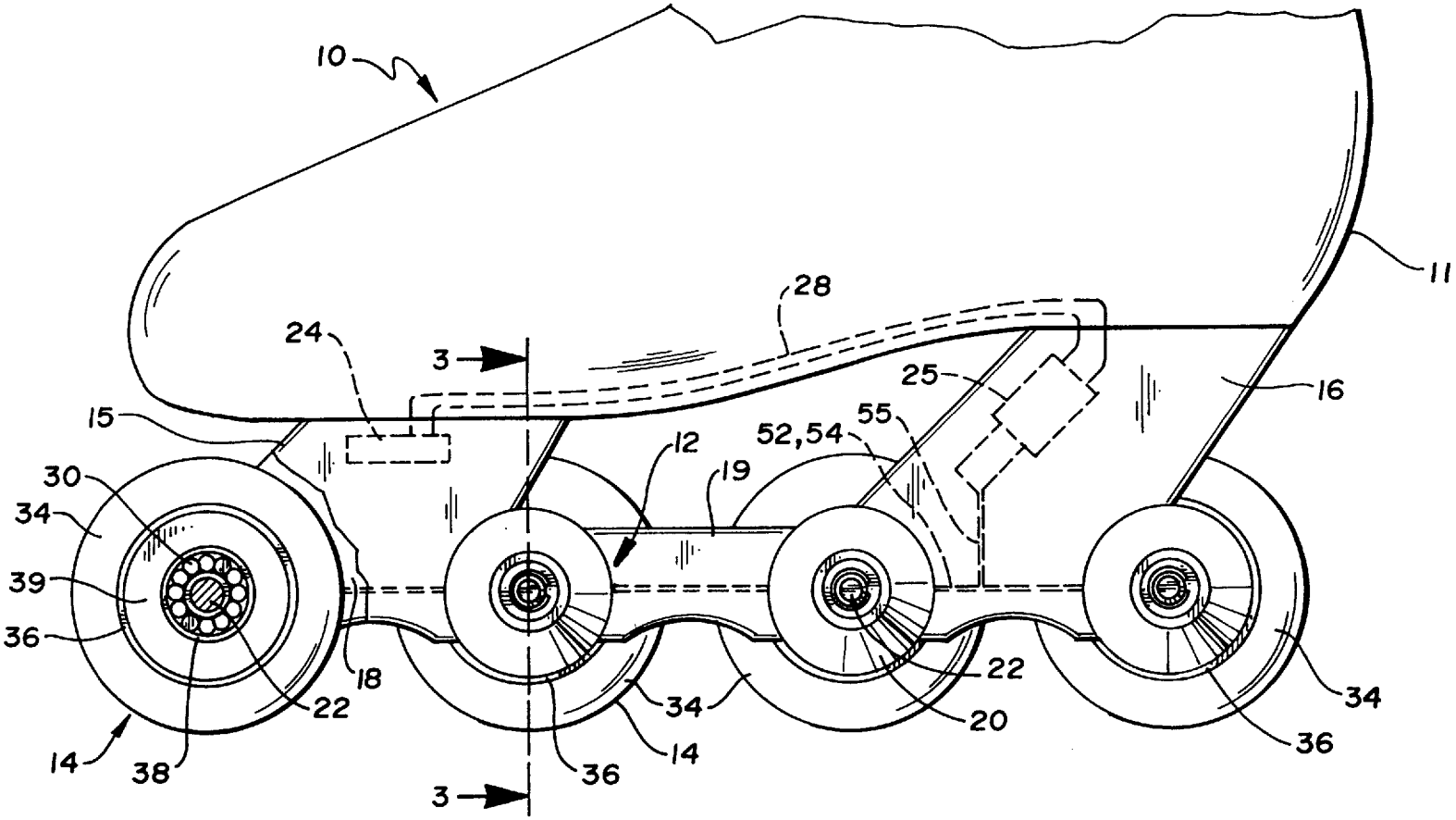
FIG. 1 is an elevational side view, with portions broken away and with internal portions shown in broken lines, of an in-line skate incorporating the brake system in accordance with the present invention.
Figure 2:
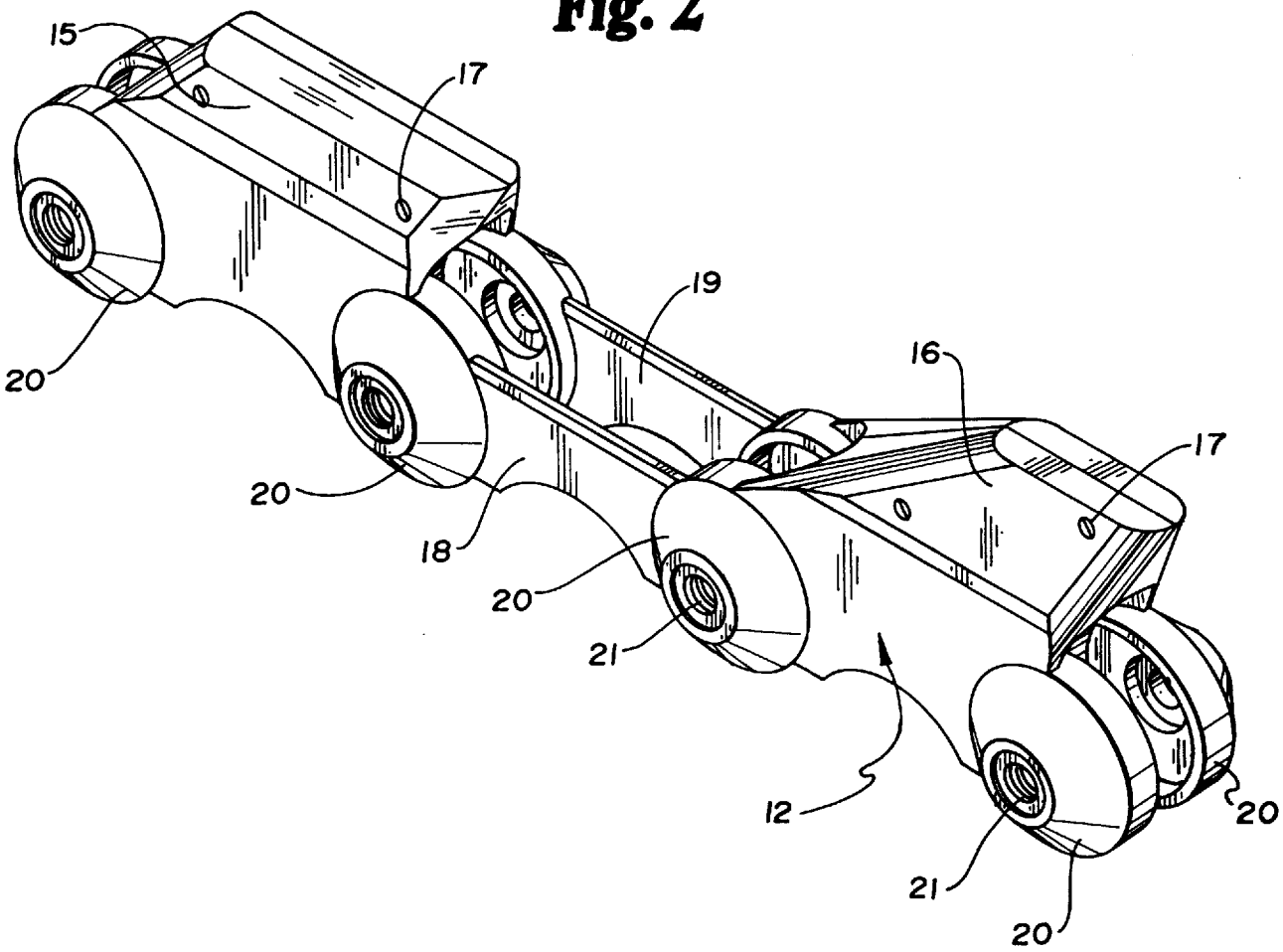
FIG. 2 is an isometric view of the wheel support frame for the in-line skate of FIG. 1.

With reference to FIG. 1, the brake in accordance with the present invention is incorporated into an in-line skate illustrated generally in FIG. 1 by the reference character 10. The skate includes a boot 11 and a wheel assembly comprised of a frame 12 and a plurality of wheels 14. The frame 12 is rigidly secured to the bottom or sole portion of the boot 11 in accordance with techniques known in the art and rotatably supports the wheels 14. As illustrated best with reference to both FIGS. 1 and 2, the frame 12 is a two part member comprising a forward support portion 15, a rearward support portion 16 and a pair of side support members 18 and 19. In the preferred embodiment, the forward and rearward portions 15 and 16 are connected with the bottom of the boot 11.

Figure 3:
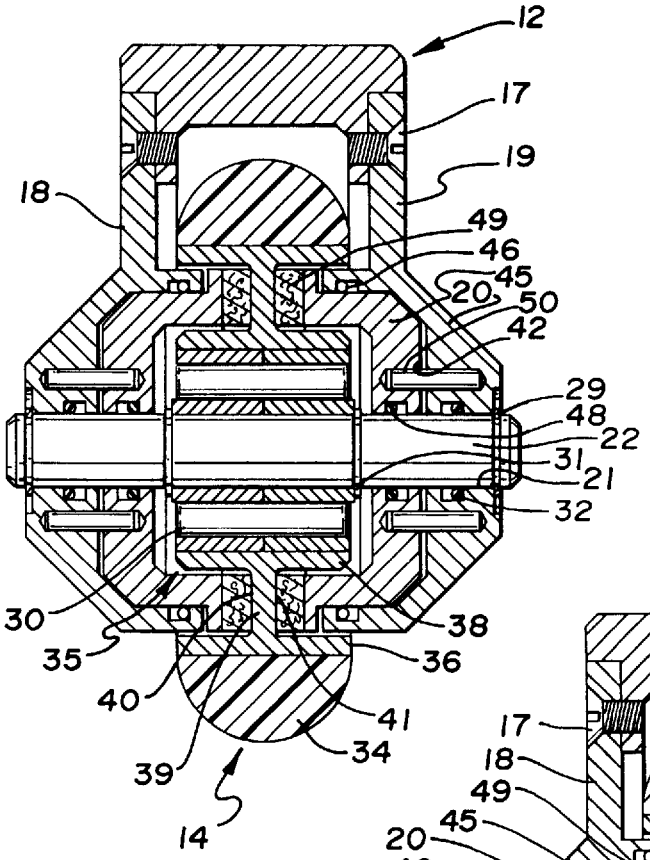
FIG. 3 is a cross-sectional view of a first embodiment of the brake structure for one of the in-line skate wheels as taken along the section line 3—3 of FIG. 1.

Each of the side support frame portions 18 and 19 extends from the forward to the rearward end of the skate 10 and includes a plurality of enlarged, integrally formed cylinder housings 20. As shown best in FIG. 2, the side frame support members 18 and 19 are spaced from one another and extend generally parallel to one another along the entire length of the skate. Spaced longitudinally along the frame members 18 and 19 are the cylinder housings 20 which, together with corresponding cylinder housings in the other of the frame members 18 and 19, form a pair of opposed cylinder housings 20. Each cylinder housing includes a central opening 21 for receiving a wheel support shaft 22 (FIG. 3). In the preferred embodiment, the frame 12 is constructed of a hard structural plastic such as ABS.

With continuing reference to FIG. 1, the forward frame portion 15 includes a cavity 24 for housing or carrying a receiver and a power means such as a battery for the remote control system as will be described below. The rearward frame portion 16 includes a cavity 25 for housing or carrying the fluid pressure supply means in the form of a linear servo, a piston/cylinder assembly and a supply of pressurizable fluid. The pressurized fluid is provided from the fluid pressure supply means to each of the cylinder housings 20 through fluid pressure supply lines 52,54,55 in the frame member 12. An electrical lead 28 extends from the receiver and battery cavity 24 to the fluid pressure supply means cavity 25 to provide electrical power to the linear servo.

Reference is next made to FIG. 3 showing a first embodiment of the fluid pressure brake and wheel assembly of the preferred embodiment. As shown, the corresponding cylinder housing portions 20,20 of the side frame support members 18 and 19 include a central opening or bore 21 to receive a wheel support shaft 22. The shaft 22 extends through the corresponding pair of cylinder housing members 20 from the outer edge of one member to the outer edge of the other. The shaft 22 is retained axially relative to the cylinder housing members 20,20 by retaining rings 29,29. The shaft 22 is fixed relative to the housing members 20,20 and its central portion rotatably supports the wheel 14 via an appropriate bearing member 30. The bearing 30, and thus the wheel 14, are positioned and retained axially relative to the shaft 22 by a pair of retaining rings 31,31. In the embodiment of FIG. 3, opposite ends of the shaft 22 are engaged in sealing relationship with the bore 21 of each of the cylinder housing members 20,20 by a pair of o-ring seals 32,32.

The wheel 14 includes a peripheral edge portion 34 constructed of a hard rubber or other synthetic material commonly used for in-line skate wheels and an annular rim portion 35 positioned between the peripheral edge 34 and the central bearing 30. The rim 35 includes an outer generally cylindrical portion 36 having an outer surface secured to the peripheral portion 34, an inner cylindrical portion 38 having an inner surface connected with the outer race of the bearing 30 and a connecting web portion 39 integrally formed with and extending between the portions 35 and 36. Each of the cylindrical portions 35 and 36 is disposed generally axially relative to the shaft 22, while the web 39 is disposed generally radially relative to the shaft 22. The web 39 includes generally annular surfaces 40 and 41 on opposite sides. These surfaces 40 and 41 function as braking surfaces when the brake is actuated.

Each of the cylinder housing members 20,20 includes an inner surface 42 adapted for receiving a brake piston 45. A seal member in the form of an o-ring seal 46 is positioned between a first or radially outer surface portion of the piston 45 and the inner surface 42 to provide sealing relationship between the piston 45 and its corresponding cylinder housing member 20. In the embodiment of FIG. 3, a further seal member in the form of the o-ring seal 48 is positioned between a second or radially inner surface of the piston 45 and the outer surface of the shaft 22 to form a seal therebetween. With this structure, a fluid pressure chamber 44 is defined between the inner surface 42 of each cylinder housing member 20 and the surface portion of the piston 45 between the seal members 46 and 48.

Each piston 45 includes a brake surface in the form of the annular brake wear pad 49. As shown, the brake pads 49 of the pistons 45 are positioned on opposite sides of the central web 39 of the wheel 14 and are adapted for selective axial movement into engagement with the web 39 for braking the wheel 14. Although the preferred embodiment shows the brake pad 49 as connected with the brake piston 45, the brake pad 49, if desired, can be connected with or be a part of opposite sides of the web 39.

A plurality of dowel pins 50 are positioned between the cylinder housing members 20 and their corresponding brake pistons 45. The dowel pins 50 extend into corresponding bores in the cylinder housing members 20 and pistons 45 to permit limited axial movement of the brake pistons 45 relative to their respective housing members 20. These dowel pins 50 also prevent any relative rotational movement between the pistons 45 and members 20. As will be described below, the brake pistons 45 are moveable axially relative to their housings 20 in response to the introduction of fluid pressure into the corresponding fluid pressure chambers 44. Accordingly, each of the pistons 45 is moveable between an extended or, braking position in which the brake pads 49 are in braking engagement with the web 39, and a retracted or non-braking position in which the brake pads 49 are not engaged with the web 39.

In the structure of the preferred embodiment of the brake illustrated in FIG. 3, each of the housing members 20 and the brake pistons 45 completely encircle the shaft 22. Similarly, the brake surfaces 40 and 41 of the web 39 as well as the brake surfaces on the brake pads 49 completely encircle the shaft 22 and provide a braking force along substantially the entire annular surface of the web 39. It is possible, if desired, however, for the annular brake pad 49 to be comprised of brake pad sections.

Figure 4:
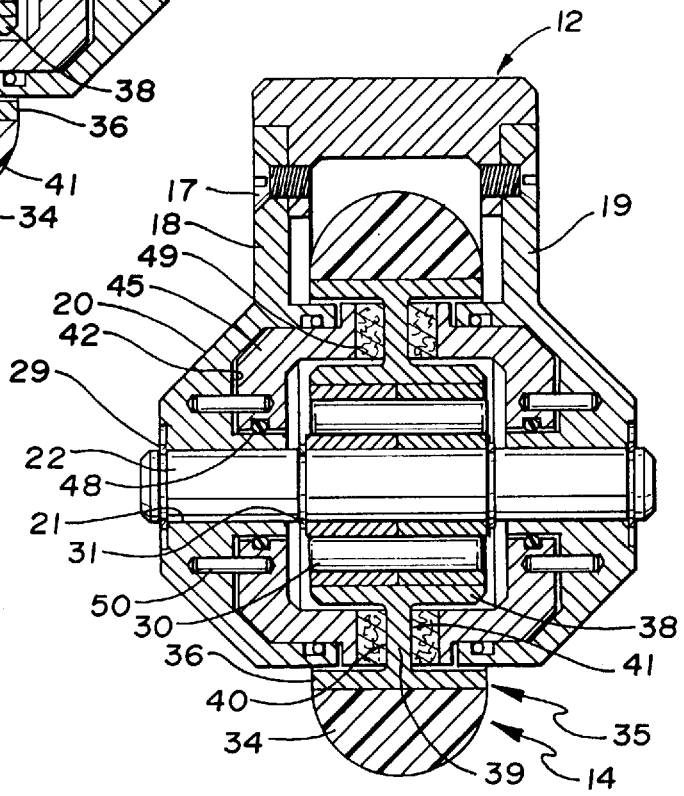
FIG. 4 is a cross-sectional view, similar to that of FIG. 3, of a second embodiment of the brake structure of the present invention.

Further, as illustrated in FIG. 4 showing a second brake embodiment, the piston 45 can be mounted entirely within the housing 20. In this embodiment, the o-ring seal member 32 can be eliminated. Further, the seal member 48 is provided between the second or radially inner seal surface of the piston 45 and a portion of the surface 42 of the member 20.

Figures 5, 6:
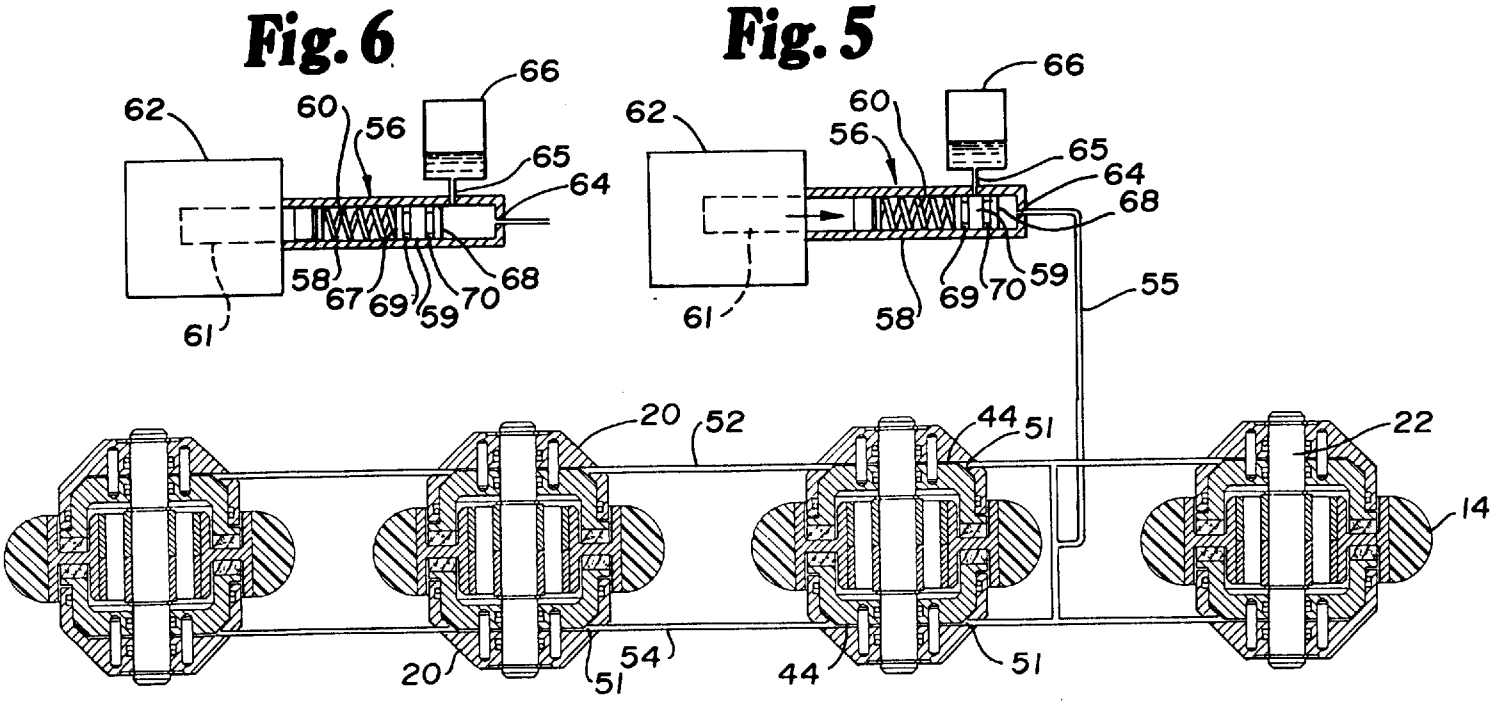
FIG. 5 is a schematic diagram of the fluid pressure brake system of the present invention.
FIG. 6 is a schematic diagram showing the fluid pressure source means, namely, the master cylinder, master piston and spring in a position in which the brakes are disengaged.
Figure 7:
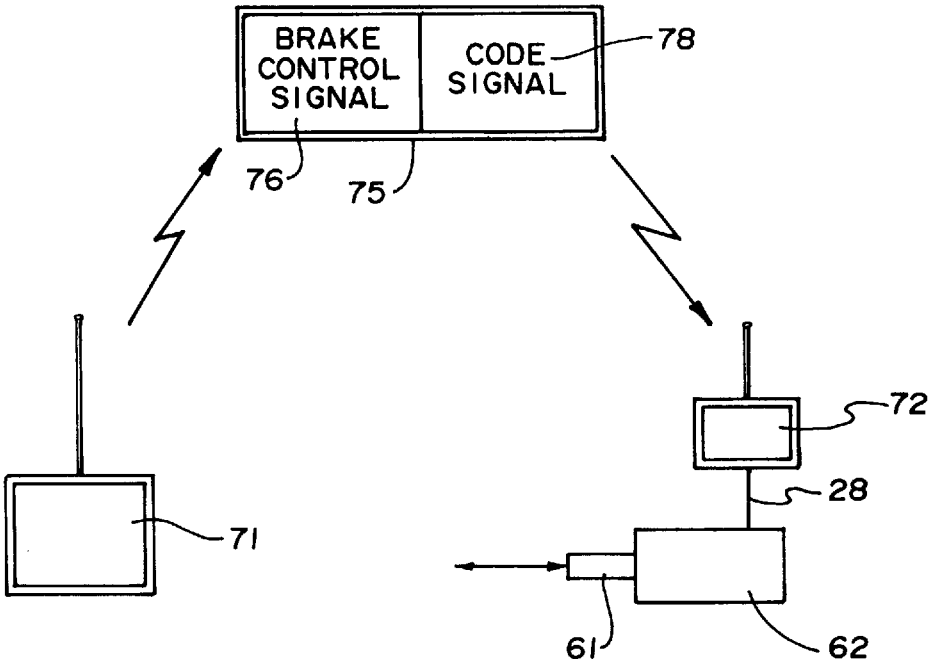
FIG. 7 is a schematic diagram of the remote control system for the in-line skate brake in accordance with the present invention.

As illustrated in FIG. 5, each of the fluid pressure chambers 44 includes a port 51 for introducing fluid pressure into, and exhausting fluid pressure from, the chambers 44. The fluid pressure is provided to the ports 51 by fluid pressure lines 52, 54 and 55. In the preferred embodiment, the fluid pressure lines 52 and 54 are formed as openings or bores within each of the side frame members 18 and 19 and function to provide fluid pressure to the fluid pressure chambers 44. The fluid pressure lines 52 and 54 are joined with fluid pressure line 55 which is in turn connected with a means 56 (FIGS. 5 and 6) for selectively providing fluid pressure to the line 55.

With reference to FIGS. 5 and 6, the means 56 for providing fluid pressure includes a master cylinder 58, a master piston 59, a cylinder spring 60 and a plunger 61 actuated by a linear actuator such as a linear servo 62. The master cylinder 58 includes a generally cylindrical wall having an opening 64 at a forward end for communication with the fluid line 55 and a second opening or port 65 in communication with a brake fluid reservoir 66.

Positioned within the master cylinder 58 is the master piston 59. The piston 59 includes a forward end 68, a rearward end 67 and a pair of axially spaced o-rings 69 and 70. The rearward end 67 of the piston 59 is engaged by the spring 60 which is positioned between a forward end of the plunger 61 and the rearward end 67 of the piston 59. The plunger 61 is movable axially relative to the master cylinder 58 by a linear servo 62. In the preferred embodiment, the servo 62 is electrically powered by a battery or the like positioned within the cavity 24 of the main skate frame 20 (FIG. 1). Linear servo's of the type which can be utilized in the present invention are known in the art.

With continuing reference to FIGS. 5 and 6, the master piston 59 is moveable axially within the cylinder 58 between a retracted or brake disengaged position illustrated in FIG. 6 and an extended or brake engaged position illustrated in FIG. 5. When in the brake disengaged position illustrated in FIG. 6, both of the piston o-rings 69 and 70 are to the left side of the brake fluid reservoir port 65. When in this position, the brake fluid in the lines 55, 52 and 54 and thus in the chambers 44 (FIG. 3) is in communication with the reservoir 66 and thus is not pressurized.

When the brake is to be engaged, actuation of the linear servo 62 causes the plunger 61 to move toward the right as viewed in FIGS. 5 and 6 against the force of the spring 60. This movement of the plunger 61 is transferred through the compression spring 60 to the piston 59, thereby resulting in corresponding movement of the piston 59 toward the right or forwardly within the cylinder 58. When such movement has been sufficient for the forward o-ring seal 70 to pass the port 65 as shown in FIG. 5, further movement of the piston 59, or rearward force exerted on the piston 59, causes the build-up of fluid pressure in the forward end of the cylinder 58. This fluid pressure is transmitted through the lines 55, 52 and 54, through the ports 51 and into the chambers 44. This in turn causes movement of the brake pistons 45, and thus the brake pads 49, toward a brake engaging position in which the brake pads 49 engage opposite sides of the web 39.

In the preferred embodiment, the spring 60 has a linear force/displacement relationship. Thus, the spring load or force exerted on the piston 59 by the spring 60 is proportional to the actuation stroke of the plunger 61. In other words, the greater the plunger stroke, the greater the force exerted by the spring 60 against the piston 59, and thus the greater the fluid pressure in the forward end of the cylinder 58. Because the braking force is proportional to the braking fluid pressure in the forward end of the cylinder 58, the braking force is also correspondingly proportional to the stroke of the plunger 61, and thus the brake control signal for moving the plunger 61.

To disengage the brake, the plunger 61 is retracted, this results in corresponding withdrawal of the spring force and rearward movement of the piston 59 to the position illustrated in FIG. 6 in which the o-ring seal 70 is positioned to left of the fluid reservoir port 65. In this position, the fluid in the system is in communication with the low pressure reservoir 66 and thus is not pressurized.

Figure 8:
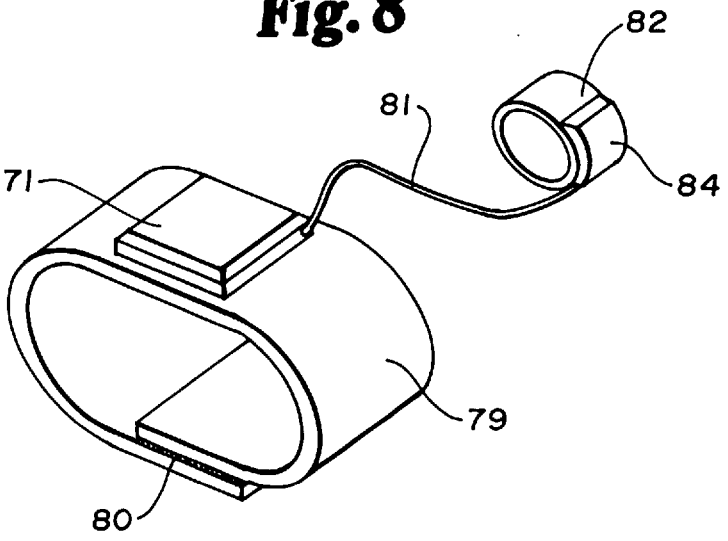
FIG. 8 is an isometric view of the hand held actuating device and transmitter for the remote control in-line brake system of the present invention.

A further aspect of the present invention is to control an in-line skate brake, and in particular the brake system previously described, via remote control means. This means is illustrated schematically in FIG. 8. Specifically, the means includes a remote transmitter 71 and a receiver 72. In the preferred embodiment, the receiver 72 is carried by the frame by being contained within the cavity 24 in the forward portion 15 as illustrated best in FIG. 1. The receiver 72 and associated electrical power means are in turn electrically connected with the linear actuator or servo 62 via the electrical lead 28. During operation, a signal 75 is transmitted from the remote transmitter 71 to the receiver 72 which then applies an appropriate signal for actuating the linear servo 62. It is intended that various signals and technologies known in the art can be utilized in transmitting a signal from the transmitter 71 to the receiver 72. The preferred embodiment, however, contemplates the use of a radio frequency signal. Also, in the preferred embodiment, the radio signal 75 which is transmitted is a two part signal. A first part of the signal is a code or verification signal 78 verifying that the brake with which the transmitter 71 is associated is in fact the correct brake, and a second portion comprising a brake control signal 76 which controls actuation of the servo 62 and thus the linear movement of the plunger 61.

In the preferred embodiment, the transmitter 71 is intended to be a remote transmitter which is hand held by the user of the skate with which the transmitter is associated. The hand held transmitter in accordance with the present invention is illustrated best in FIG. 8. As shown, the transmitter 71 is mounted onto an arm wrap 79 which includes means such as Velcro or the like enabling the arm wrap to be secured to the arm or wrist of the user. The device also includes a finger ring member 82 which is preferably positioned on the user's index finger. The ring 82 is provided with an actuation button 84 which may be engaged by the thumb. Preferably, the actuation button 84 is spring biased so that the more it is depressed the more resistance is felt by the user. In this way, the user can experience a feedback of the actual braking force being applied. An electrical lead 81 connects the actuation button 84 with the transmitter 71. Preferably, a separate transmitter, receiver and brake system, with independent verification or code signal, is provided for each skate of a pair of skates.

Having described the details of the preferred embodiment, the operation of the brake of the present invention can be understood as follows. First, the user puts on the skates with the fluid pressure source means and brake system incorporated therein and positions and connects the arm wrap mounted transmitter and the ring to each arm or wrist and corresponding index finger of the user. When the user desires one or both of the skates to be braked, the actuation button 84 for the skate in question is depressed. This causes the transmission of a signal from the transmitter 71 to the receiver 72. After verifying that the transmitter 71 is in fact the transmitter associated with the particular skate in question, the brake control signal actuates the linear servo 62 resulting in linear advancement of the plunger 61. This in turn causes compression of the spring 60 and corresponding forward movement of the piston 59 so that the o-ring 70 pass the fluid reservoir port 65. Further, forward movement of or pressure on, the plunger 61 creates compression of the fluid at the forward end of the cylinder 58. This pressure is transmitted through the pressure lines 55, 54 and 52 to the pressure chambers 44 resulting in movement of the brake pistons 45, and their corresponding brake pads 49, into braking engagement with the web 39 of the wheel 14. If increased braking force is desired, the actuation button 84 is depressed further, thereby resulting in greater linear movement of the plunger 61 and thus generation of increased braking pressure within the fluid pressure system.

When the actuation button 84 is released, the plunger 61 retracts, thereby causing rearward movement of the piston 59 to a point where the o-ring 70 is to the left side of the port 65 as viewed in FIG. 6. This results in the fluid pressure within the pressure system being in communication with the low pressure fluid reservoir 66.

Although the description in the preferred embodiment has been quite specific, it is contemplated that various changes and modifications could be made without deviating from the spirit of the present invention. Accordingly, it is intended that the present invention be dictated by the appended claims rather than by the description of the preferred embodiment.

We claim:

1. An in-line skate having a fluid pressure brake comprising:

a wheel support frame;

a plurality of wheels rotatably supported on a shaft between opposed portions of said support frame, at least one of said plurality of wheels including a first annular braking surface;

a fluid pressure chamber defined by at least one of said support frame portions;

a brake piston encircling said shaft, and being moveable in response to fluid pressure in said fluid pressure chamber between a braking position and a non-braking position, said brake piston further having a second braking surface adapted for braking engagement with said first braking surface when said brake piston is in said braking position; and a fluid pressure port in said fluid pressure chamber for introducing fluid pressure into and exhausting fluid pressure from said fluid pressure chamber.

2. The in-line skate of claim 1 wherein said second braking surface is an annular surface extending around said shaft.

3. The in-line skate of claim 1 wherein said piston includes inner and outer cylindrically shaped seal surfaces and carrying inner and outer seal members, respectively, to define a portion of said fluid pressure chamber.

4. The in-line skate of claim 1 wherein said shaft has a longitudinal axis defining an axial direction and wherein said wheel support frame is fixed relative to said shaft.

5. The in-line skate of claim 4 including a pin extending in a direction parallel to said longitudinal axis for preventing rotational movement of said brake piston about said shaft and relative to said wheel support frame.

6. The in-line skate of claim 1 including a fluid pressure source carried by said support frame and a fluid pressure communication line between said fluid pressure source and said fluid pressure port.

7. The in-line skate of claim 6 including a remote control transmitter and a support frame mounted receiver for selectively activating said fluid pressure source.

8. The in-line skate of claim 7 wherein said fluid pressure source includes a linear servo.

9. The in-line skate of claim 7 wherein said transmitter is capable of transmitting a two part signal including a validation signal part and a brake control signal part.

10. The in-line skate of claim 1 wherein said fluid pressure is hydraulic fluid pressure.

11. The in-line skate of claim 1 including a pair of fluid pressure chambers defined by opposed support frame portions and a pair of brake pistons positioned on opposite sides of said at least one wheel.

12. An in-line skate and brake combination comprising:

a wheel support frame;

a plurality of wheels rotatably mounted to said support frame, at least one of said plurality of wheels including a first brake surface;

a hand held radio frequency transmitter capable of selectively transmitting a brake signal and free of any physical connection with said wheel support frame;

a brake signal receiver carried by said support frame; and a brake associated with at least one of said wheels and carried by said wheel support frame, said brake including a second brake surface moveable between a brake position in which said first and second brake surfaces are engaged and a non-brake position in which said first and second brake surfaces are disengaged, said second brake surface further being movable into said brake position in response to receipt of said brake signal by said brake signal receiver.

13. The in-line skate and brake combination of claim 12 wherein said brake is a fluid pressure brake and includes a fluid pressure source carried by said support frame.

14. The in-line skate and brake combination of claim 13 wherein said fluid pressure source includes a spring biased piston and a linear actuator operatively connected with said spring biased piston.

15. The in-line skate and brake combination of claim 12 including an electrical power source carried by said support frame.

16. The in-line skate and brake combination of claim 12 wherein said brake signal is a two part signal including a validation signal part and a brake control signal part and wherein said second brake surface is moveable into said brake position in response to said brake control signal part.

17. The in-line skate and brake combination of claim 12 wherein said brake includes a brake force generator carried by said support frame wherein said brake force generator is responsive to receipt of said brake signal and said second brake surface is moveable into a brake position by said brake force generator.

18. The in-line skate and brake combination of claim 12 wherein said brake includes force means mounted to support frame for generating a brake force, said force means being responsive to aid brake signal to move said second brake surface into a braking position.

* * * * *